US007786416B2

(12) United States Patent
Williams et al.

(10) Patent No.: US 7,786,416 B2
(45) Date of Patent: Aug. 31, 2010

(54) COMBINATION CONDUCTOR-ANTENNA

(75) Inventors: Brett A. Williams, Arlington, TX (US); Brian C. Baker, Arlington, TX (US); Wayne K. Schroeder, Mansfield, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 789 days.

(21) Appl. No.: 11/456,792

(22) Filed: Jul. 11, 2006

(65) Prior Publication Data

US 2007/0238412 A1 Oct. 11, 2007

Related U.S. Application Data

(62) Division of application No. 10/742,670, filed on Dec. 19, 2003.

(51) Int. Cl.
*F41G 7/00* (2006.01)
*F42B 5/00* (2006.01)

(52) U.S. Cl. ..... 244/3.1; 102/441

(58) Field of Classification Search ..... 102/438, 102/439, 441, 444; 343/772, 777, 705; 244/3.1, 244/3.11, 3.12; 89/1.11
See application file for complete search history.

(56) References Cited

U.S. PATENT DOCUMENTS

| | | | | |
|---|---|---|---|---|
| 3,649,742 | A | 3/1972 | Tissot | |
| 4,047,464 | A | 9/1977 | Fredriksson et al. | |
| 4,148,543 | A | 4/1979 | Shores | |
| 4,465,985 | A | 8/1984 | Milligan | |
| 4,490,002 | A | 12/1984 | Fowler | |
| 4,508,404 | A | 4/1985 | Frawley | |
| 4,757,324 | A | 7/1988 | Dhanjal | |
| 4,792,814 | A | 12/1988 | Ebisui | 343/786 |
| 4,864,318 | A | 9/1989 | Iwasaki et al. | |
| 4,972,199 | A | 11/1990 | Raghavan et al. | |
| 5,200,757 | A | 4/1993 | Jairam | |
| 5,245,353 | A | 9/1993 | Gould | 343/786 |
| 5,426,442 | A | 6/1995 | Haas | |
| 5,478,028 | A * | 12/1995 | Snyder | 38/47 |
| 5,652,404 | A | 7/1997 | Girard | |
| 5,710,388 | A | 1/1998 | Hutchinson | |
| 5,962,806 | A * | 10/1999 | Coakley et al. | 102/502 |
| 6,118,412 | A | 9/2000 | Chen | |
| 6,215,457 | B1 | 4/2001 | Losey | |

(Continued)

OTHER PUBLICATIONS

U.S. Appl. No. 10/742,670, filed Dec. 19, 2003, Williams et al.

(Continued)

*Primary Examiner*—Douglas W Owens
*Assistant Examiner*—Minh D A
(74) *Attorney, Agent, or Firm*—Williams, Morgan & Amerson, P.C.

(57) ABSTRACT

A combination conductor-antenna apparatus is provided comprising a surface that defines a passage for use as a receptor for a second conductor and for use as a waveguide. The surface is at least partially formed of an electrically conductive material, thus allowing the apparatus to serve as a medium by which an electrical signal can be transferred from a second conductor. Disposed within the passage is a pickup element for sensing and/or injecting electromagnetic energy in the passage, thus allowing the apparatus to serve as a medium for wireless communications.

16 Claims, 10 Drawing Sheets

U.S. PATENT DOCUMENTS

| | | | | |
|---|---|---|---|---|
| 6,254,394 | B1 * | 7/2001 | Draper et al. | 434/11 |
| 6,281,855 | B1 | 8/2001 | Aoki | |
| 6,452,561 | B1 | 9/2002 | West et al. | 343/772 |
| 6,501,417 | B1 | 12/2002 | Bowlds | |
| 6,507,323 | B1 | 1/2003 | West | 343/772 |
| 6,604,946 | B2 * | 8/2003 | Oakes | 434/11 |
| 6,813,964 | B1 | 11/2004 | Clark et al. | 73/861.52 |
| 6,892,644 | B2 * | 5/2005 | Rastegar et al. | 102/213 |
| 7,291,014 | B2 * | 11/2007 | Chung et al. | 434/11 |
| 2003/0060288 | A1 * | 3/2003 | Oakes | 463/51 |
| 2003/0210170 | A1 * | 11/2003 | Krikorian et al. | 342/62 |
| 2004/0257284 | A1 | 12/2004 | Rada et al. | 343/702 |

OTHER PUBLICATIONS

Nov. 9, 2005 Non-Final Rejection for U.S. Appl. No. 10/742,670.
Mar. 10, 2006 Non-Final Rejection for U.S. Appl. No. 10/742,670.
Aug. 23, 2006 Non-Final Rejection for U.S. Appl. No. 10/742,670.
Nov. 29, 2006 Final Rejection for U.S. Appl. No. 10/742,670.
Sep. 19, 2007 Examiner's Answer to Appeal Brief.

* cited by examiner

COMBINATION CONDUCTOR-ANTENNA

This is a divisional of co-pending application Ser. No. 10/742,670, entitled "Combination Conductor-Antenna" by inventors Williams, Baker and Schroeder, filed on Dec. 19, 2003, for which the earlier effective filing date is hereby claimed.

FIELD OF THE INVENTION

This invention relates to a combined antenna and conductor, such as a contact element that serves as a combination conductor and waveguide antenna and/or a connector having such a contact element.

SUMMARY OF THE INVENTION

According to the present invention, a contact element is provided that can serve as both an electrical socket for direct-contact communications and can serve as a waveguide antenna for wireless communications. The contact element includes a surface extending in a longitudinal direction, the surface defining a passage that extends between an opening at a first end of the contact element and a back wall at a second end of the contact element. The contact element also includes a pickup element for injecting and/or sensing electromagnetic energy in the passage. The pickup element extends into the passage from the surface in a direction normal to the surface.

It is preferable that at least a portion of the surface be electrically conductive in order to allow for the contact element to provide direct-contact communication. The surface can include a contacting section that is electrically conductive and extends from the opening towards the back wall. The surface can also include a pickup section that is electrically conductive and extends from the back wall towards the opening. In such a case, the pickup element can extend from the pickup section of the surface. The surface can further include an insulating section between the contacting section and the pickup section for electrically isolating the contacting section and the pickup section from each other.

The surface can optionally be shaped so as to provide for mode conversion, for example to convert circular mode electromagnetic waves entering the opening into rectangular mode waves.

A distance d between the pickup element and the back wall can preferably be selected to satisfy the following relationship:

$$d=\tfrac{1}{4}\lambda_g=\tfrac{1}{4}(\lambda_o/(1-(\lambda_o/\lambda_c)^2)^{1/2})$$

where $\lambda_g$ is a wavelength of an operating frequency of the contact element (i.e., waveguide wavelength), $\lambda_c$ is a lower dominant mode cutoff wavelength of the operating frequency, and $\lambda_o$ is a wavelength of the operating frequency in free space.

The opening in the contact element can be circular and have a radius r that satisfies the following equation:

$$r=\lambda_c/k$$

where $\lambda_c$ is a lower dominant mode cutoff wavelength of an operating frequency of the contact element and k is a constant associated with an operating mode of the contact element.

According to another aspect of the invention, a connector assembly is provided that includes a support member and a contact element, supported by the support member, for mating with a pin element of an opposing connector and for serving as a waveguide for transmitting and/or receiving wireless communication.

The contact element can include a surface that extends in a longitudinal direction, defining a passage that extends between an opening at a first end of the contact element and a back wall at a second end of the contact element. The contact element can further include a pickup element for injecting and/or sensing electromagnetic energy in the passage, the pickup element extending into the passage from the surface in a direction normal to the surface.

The connector assembly can further include a second contact element, supported by the support member, for mating with a second pin element of an opposing connector, wherein the second contact element is incapable of serving as a waveguide for transmitting and/or receiving wireless communication.

According to another aspect of the invention, a projectile is provided that includes a connector having a contact element for mating with a pin element of an opposing connector in order to transfer electrical signals from the pin element and for serving as a waveguide for receiving wireless communication signals. The projectile also includes a receiver in communication with the contact element for converting the received wireless communication signals into data signals, and a data processor in communication with the contact element for receiving from the contact element the electrical signals transferred from the pin element.

According to another aspect of the invention, a projectile control system is provided that includes a projectile having a projectile connector that includes a contact element, a pre-launch controller for communicating with the projectile prior to a launch of the projectile, an umbilical cord for electrically connecting the contact element of the connector to the pre-launch controller, and a transmitting device for wirelessly communicating with the projectile via the contact element of the connector after the launch of the projectile.

BRIEF DESCRIPTION OF THE DRAWINGS

The present invention is illustrated by way of example and is not limited by the figures of the accompanying drawings, in which like reference numbers indicate similar parts.

DETAILED DESCRIPTION OF THE INVENTION

Figure 1:
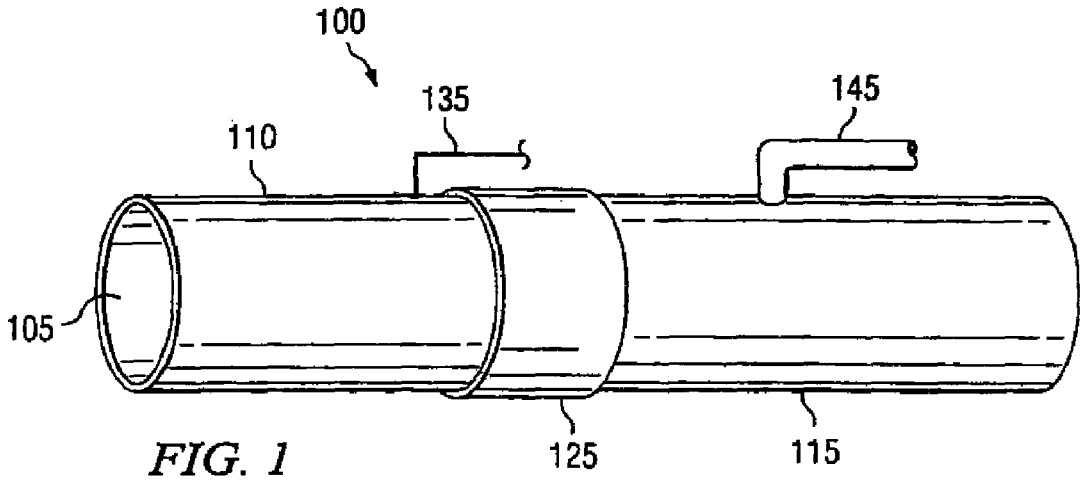
FIG. 1 shows a perspective view of a contact element according to a first embodiment of the present invention.
Figure 2:
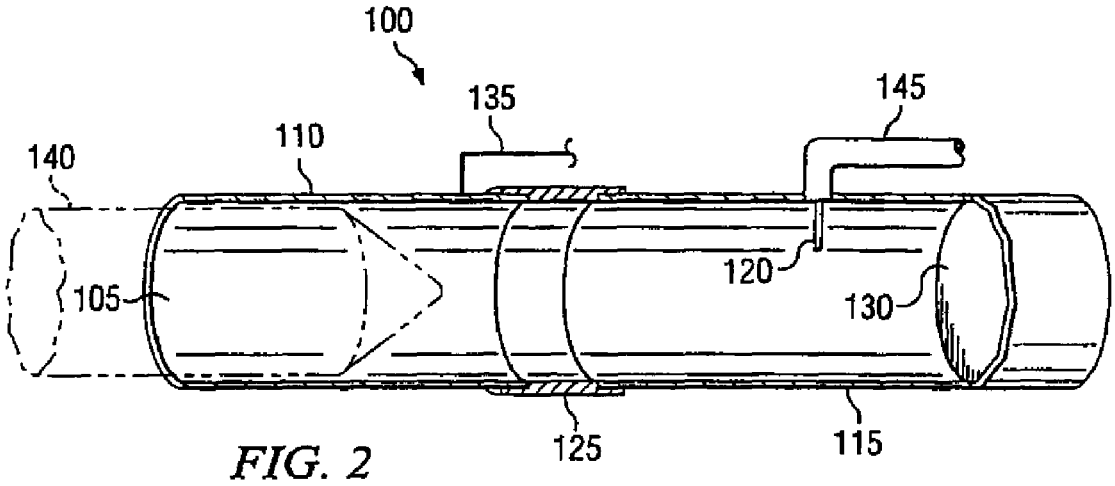
FIG. 2 shows a partially cut-away view of the contact element shown in FIG. 1.
Figure 3A:
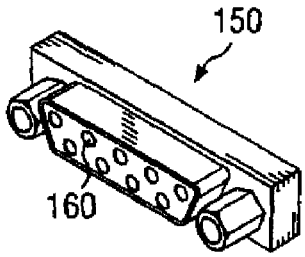
FIGS. 3A and 3B show examples of connectors that can be used in conjunction with the contact element of the present invention.
Figure 3B:
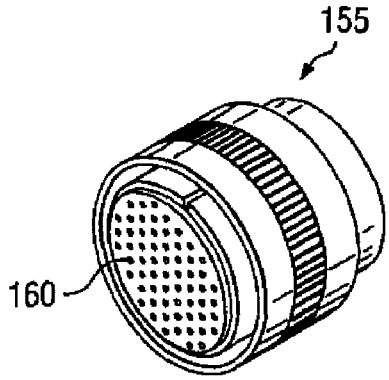

FIG. 1 shows a perspective view of a contact element 100 in accordance with a first embodiment of the invention. FIG. 2 shows a partially cut-away view of the contact element 100. The contact element 100 can be used as a socket contact in a connector, such as those shown in FIGS. 3A and 3B. Each of the connectors 150 and 155 have a plurality of sockets 160, any one or more of which can be populated with the contact element 100. The connectors 150 and 155 are shown for exemplary purposes only, and are in no way intended to limit the scope of the invention.

The contact element 100 allows for both direct-contact and contactless forms of communication. For example, the contact element 100 can provide for direct-contact communication in the form of an electrical signal such as a DC voltage and can provide for contactless communication in the form of electromagnetic waves. This is accomplished by providing the contact element 100 with a contacting section 110 for direct-contact communication and a pick-up section 115 for contactless, or wireless, communication. This allows a connector having the contact element 100 to serve as both a direct-contact connector and an antenna.

For direct-contact communication, a pin contact 140 (shown in phantom) can be inserted into the contact element 100 through opening 105. The contacting section 110 has an inner surface made of a conductive material, for example copper, silver, or gold, allowing signals to be transferred between the contact element 100 and a pin contact that has been properly inserted. A contact signal line 135 provides a signal path to and from the contacting section 110, bypassing the pick-up section 115. In addition, an insulating section 125 is provided for electrically isolating the contacting section 110 from the pick-up section 115. Thus, the pin contact 140 should be selected such that it does not extend beyond the insulating section 125 when inserted into the contact element 100.

For contactless or wireless communications, the contact element 100 can serve as a cylindrical waveguide, where the opening 105 is the waveguide aperture. A probe 120 is provided in the pick-up section 115 for absorbing and/or injecting electromagnetic energy in the contact element 100. The inner surface of the pick-up section 115, including a back wall 130, is made of a conductive material, for example copper, silver or gold.

Thus, at times when there is no pin contact inserted in the contact element 100, the contact element 100 is open and can serve as a circularly polarized antenna. Apertures like antennas act as high-pass filters with a cutoff wavelength set by dimensions of the aperture, which in the first embodiment is the opening 105. In the case of circular apertures, the cutoff wavelength differs for different modes of operation, where a "mode" refers to the shape and structure of electromagnetic field-lines carried within the waveguide once the field has passed into the waveguide from its associated aperture. The dominant mode in a circular waveguide is a transverse electric (TE) mode known as $TE_{11}$, shown in FIG. 4. Other modes possible with a circular waveguide include $TE_{01}$, also shown in FIG. 4, and a transverse magnetic (TM) mode known as $TM_{01}$. Circular cutoff wavelengths $\lambda_c$ are dependent upon a product of a radius of the waveguide opening and a constant k, which varies among different modes. For example, for $TE_{11}$, $TE_{01}$, and $TM_{01}$ modes the constants are shown in Table 1 below (where r is radius).

TABLE 1

| | $TM_{01}$ | $TE_{11}$ | $TE_{01}$ |
|---|---|---|---|
| k | 2.61 | 3.412 | 1.640 |

Thus, the size (inner diameter) of the opening 105 has an impact on cutoff and allowed mode. For example, the cutoff wavelength $\lambda_c$ for a circular waveguide for $TE_{11}$ mode is $\lambda_c=(k)(r)=(3.412)(r)$. If the cutoff frequency $\lambda_c$ for this mode is set at 30 GHz, r is found to be $r_{30}=0.293$ cm (solving for $r=\lambda_c/3.412=(c/30\text{ GHz})/3.412$, where c=speed of light), or in inches, $r_{30}=0.12$ in. If the cutoff frequency $\lambda_c$ for this mode is set at 90 GHz, r is found to be $r_{90}=0.088$ cm, or in inches, $r_{90}=0.035$ in.

Figure 4:
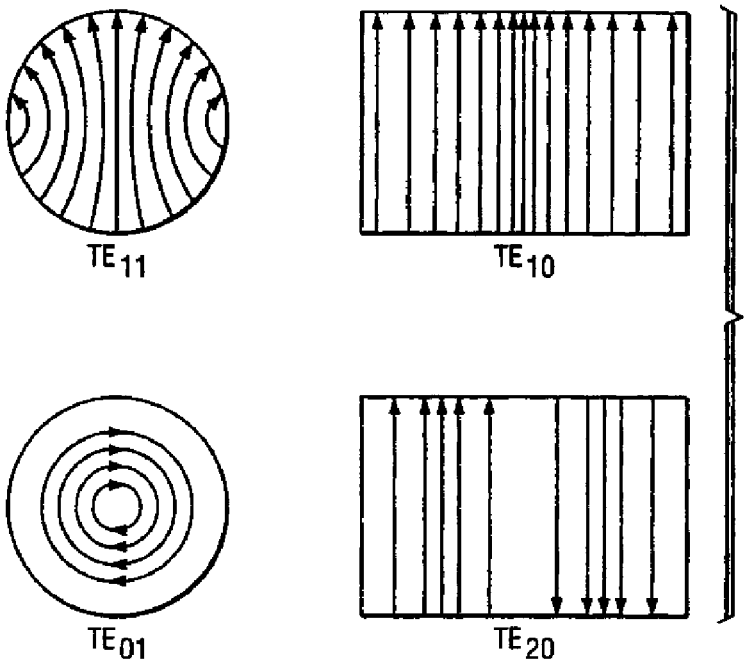
FIG. 4 shows field lines associated with various waveguide modes.
Figure 5:
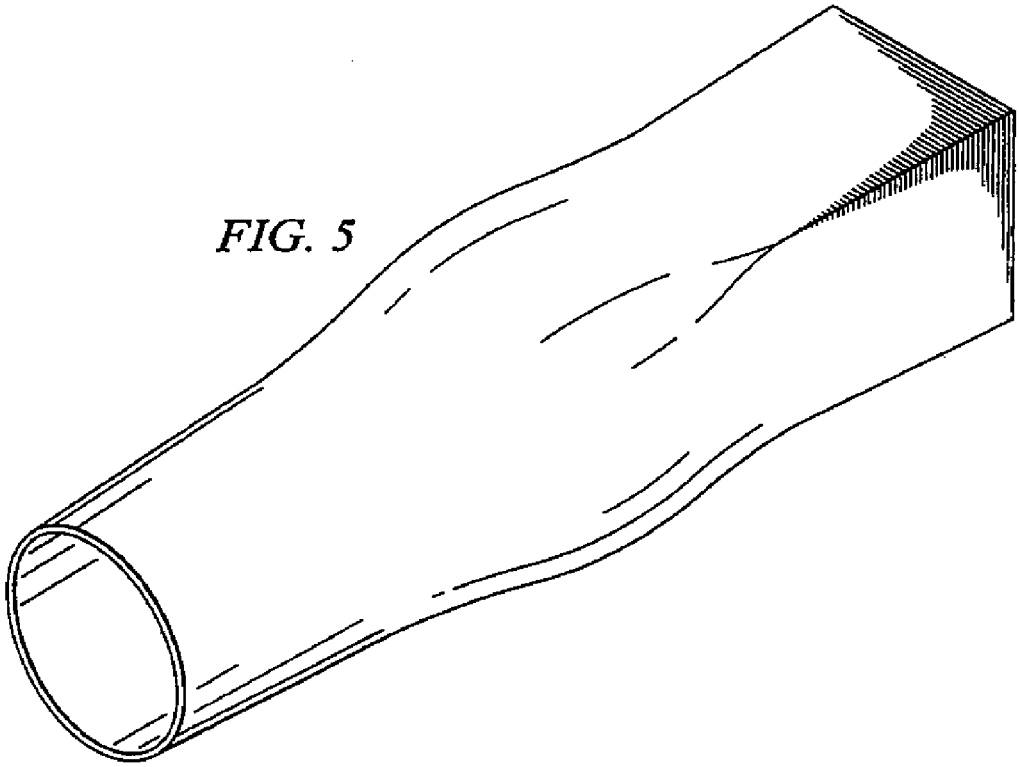
FIG. 5 shows a geometry that can be used for the contact element of the present invention.

The shape of the contact element of the present invention can vary from a cylinder. For example, the shape of the contact element can vary in order to allow for mode conversion. Methods of designing waveguides to cause a specified mode conversion are known in the art. However, since the contact element of the present invention can serve as both a socket for mating with a pin contact and a waveguide for wireless communication, the shape of the contact element is preferably selected to allow for at least a portion of the inner side of the contact element nearest the opening to make contact with an inserted pin contact. As an example, in FIG. 5 a geometry is shown that can be implemented as an alternative shape for the contact element 100. The geometry shown in FIG. 5 extends in a longitudinal direction and has an opening at one end thereof, a back wall at the other end thereof, and a surface that defines an inner passage extending between the opening and the back wall. Beginning at the opening, a first portion of the surface is cylindrical and has a constant diameter, a second portion of the surface is cylindrical and has a gradually increasing diameter, a third portion of the surface is cylindrical and has a gradually decreasing diameter, a forth portion of the surface is a gradual transition from a cylindrical shape to a rectangular shape while the diameter continues to gradually decrease, and a fifth portion of the surface has a rectangular cross-section having a constant size. Since the first portion of the surface has a constant diameter, a portion of the inner side of the contact element nearest the opening can make contact with a cylindrical pin contact. The geometry shown in FIG. 5 also provides for converting circular $TE_{01}$ waves to rectangular $TE_{20}$ waves and for converting circular $TE_{11}$ waves to rectangular $TE_{10}$ waves. FIG. 4 shows the electric field lines for each of these modes.

The insulating section 125 is made of a dielectric insulating material suitable for protecting the pick-up section 115 from data voltage. Since the inner surface of the insulating section 125 is an insulating material rather than a conductive material, the insulating section 125 interrupts the internal waveguide field by providing a section through which the wave must travel via free space. The desirable length of this section (i.e., distance between respective inner surfaces of contacting section and pickup section) is determined based on the breakdown voltage (dielectric breakdown) of the material used to create the insulating section 125. Table 2 below shows examples of dielectric strengths for some common materials that can be used for the insulating section 125.

TABLE 2

| Material | Dielectric Constant | Dielectric Strength (V/m) |
|---|---|---|
| Air | 1.0 | $3 \times 10^6$ |
| Paper | 2-4 | $15 \times 10^6$ |
| Polystyrene | 2.6 | $20 \times 10^6$ |
| Rubber | 2.3-4.0 | $25 \times 10^6$ |
| Glass | 4-10 | $3 \times 10^6$ |
| Mica | 6.0 | $200 \times 10^6$ |

In the present embodiment, rubber is used as an easily manufactured insulating section 125 between the contacting section 110 and the pick-up section 115 and a data-line voltage of 5 volts. Using the data from Table 2, the thickness of the insulation section can be calculated as $(5V)/(25\times10^6\ V/m)=200\times10^{-9}$ m. However, this only accounts for the dielectric strength of the material used for the insulating section 125. Since air, especially near saltwater, has a lower dielectric strength, the spacing requirement between the respective outer surfaces of the contacting section 110 and the pick-up section 115 is increased. Where salt-air is a factor of 100× lower in dielectric strength than "air" (as noted in Table 2) the rubber insulating section 125 would have to be $(5V)/(10^{-2}\times3\times10^6)=0.17$ mm thick. Where salt-air is a factor of 1000× lower, the rubber insulation section would have to be $(5V)/(10^{-3}\times3\times10^6)=1.7$ mm thick.

However, the distance between the exposed portions (i.e., exposed to air) of the contacting section 110 and the pick-up section 115 need not be equal to the distance between the unexposed conductive surfaces of the contacting section 110 and the pick-up section 115. For example, as shown in FIG. 2, the insulating section 125 can be configured such that only part of the insulating section 125 actually interposes the contacting section 110 and the pick-up section 115, and the rest of the insulating section is wrapped around the exterior of the contact element 100. This configuration allows for adequate spacing between conductive outer surfaces while reducing the distance a wave must travel via free space within the contact element. It should be noted that, while FIG. 2 shows the insulation wrapping around the exterior of both the contacting section 110 and the pick-up section 115, the insulation wrapping can, instead, be positioned around the exterior of only one of the contacting section 110 or the pick-up section 115 and still be sized to provide an adequate distance between the respective outer surfaces.

To maximize RF absorption, it is desirable to optimize the placement of the probe 120 in the pick-up section 115. The optimal location for the present embodiment is determined considering a plane wave incident normally on a perfect plane conductor—similar to the condition of the back wall 130 in the contact element 100. An E-field incident on a plane conductor such as the back wall 130 experiences a 180° phase shift upon reflection. Mathematically, this is to satisfy the boundary condition that an electric field goes to zero on the surface of an ideal conductor. Intuitively, this may be seen as an electron response to being pushed in one direction at some instant, creating a reverse electromotive force (or field) effect in the opposite direction.

The incident and reflected waves produce a standing wave within the cavity of the contact element 100. The 180° phase shift noted above moves the location of maxima and minima field strength within the cavity. Avoiding a minimum of zero field—due to interference between incoming and outgoing waves—at ¼ wavelength from the back wall 130, a maximum wave energy can be found. By this simplified treatment, the probe 120 can be placed ¼ of a waveguide wavelength from the back wall 130.

However, under certain conditions, locating an optimal position for the probe 120 may not be so simple. For example, in the case of a rectangular waveguide or rectangular transition in a waveguide, the field reflects down the waveguide, off sides of the waveguide at some angle set by guide size and frequency. Phase change of reflected E-fields depends upon E-polarization with respect to the plane of incidence. The plane of incidence is defined as that plane containing both incident and reflected beams in a plane normal to the surface. For polarization perpendicular to the incident plane, the same 180° phase shift mentioned above occurs when the index of refraction in a medium the beam is from is lower than that of the medium of the incident plane. In the present embodiment, the index of refraction can be considered infinite as for a perfect conductor. Further analysis shows that dielectric/conductor interfaces behave the same for parallel polarization as for perpendicular polarization in terms of a phase shift. This equality in phase behavior for both polarizations means that it is not necessary to know the plane of incidence in the event of linear transmissions from a ground source. As a result, no matter what the orientation of the contact element 100, the probe 120 remains ¼ waveguide wavelength from the back wall 130. Optimal distance d from the back wall 130 is therefore:

$$d=\tfrac{1}{4}\lambda_g=\tfrac{1}{4}(\lambda_o/(1-(\lambda_o/\lambda_c)^2)^{1/2}) \quad (1)$$

where $\lambda_g$ is the wavelength of an electromagnetic wave within the waveguide, $\lambda_c$ is the lower dominant mode cutoff wavelength, and $\lambda_o$ is the wavelength of electromagnetic wave in free space, i.e., the free-space frequency. For example, in the case of Ka band, the free-space frequency is $f_o$=35 GHz and the cutoff frequency can be $f_c$=30 GHz, so (using $c=3\times10^6$ m/s) the distance from the back wall 130 to the probe 120 is then $\tfrac{1}{4}\lambda_g=\tfrac{1}{4}(0.86\ cm/(1-(0.86\ cm/1.0\ cm)^2)^{1/2})=0.42$ cm. As another example, in the case of W band, the free-space frequency is $f_o$=94 GHz and the cutoff frequency can be $f_c$=90 GHz, so (using $c=3\times10^6$ m/s) the distance from the back wall 130 to the probe 120 is then $\tfrac{1}{4}\lambda_g=\tfrac{1}{4}(0.316\ cm/(1-(0.316\ cm/0.33\ cm)^2)^{1/2})=0.28$ cm.

The length of the waveguide (from opening 105 to back wall 130) can be set to take advantage of the tendency of a beamwidth to narrow with sidelobes settling out once the length to diameter (of the waveguide) ratio is slightly greater than 4. Thus, in the examples from above for Ka band, having a cutoff frequency of 30 GHz ($r_{30}$=0.293 cm so $d_{30}$=0.586 cm), or for W band, having a cutoff frequency of 90 GHz ($r_{90}$=0.088 cm so $d_{90}$=0.176 cm), the length of the waveguide can be approximately:

$$\text{Waveguide Length}_{35}=2.344\ \text{cm}$$

$$\text{Waveguide Length}_{94}=0.704\ \text{cm}$$

As noted above, more than one connector socket can be populated with the contact element 100. Since the contact element 100 is such a relatively small element, it tends to behave much like an ideal, elemental, isotropic Huygens wavelet source, so a phased array approach can be used to narrow the combined beamwidth. Examples discussed below and shown in FIGS. 6-9 illustrate results of adding an array of contact elements 100.

Figure 6:
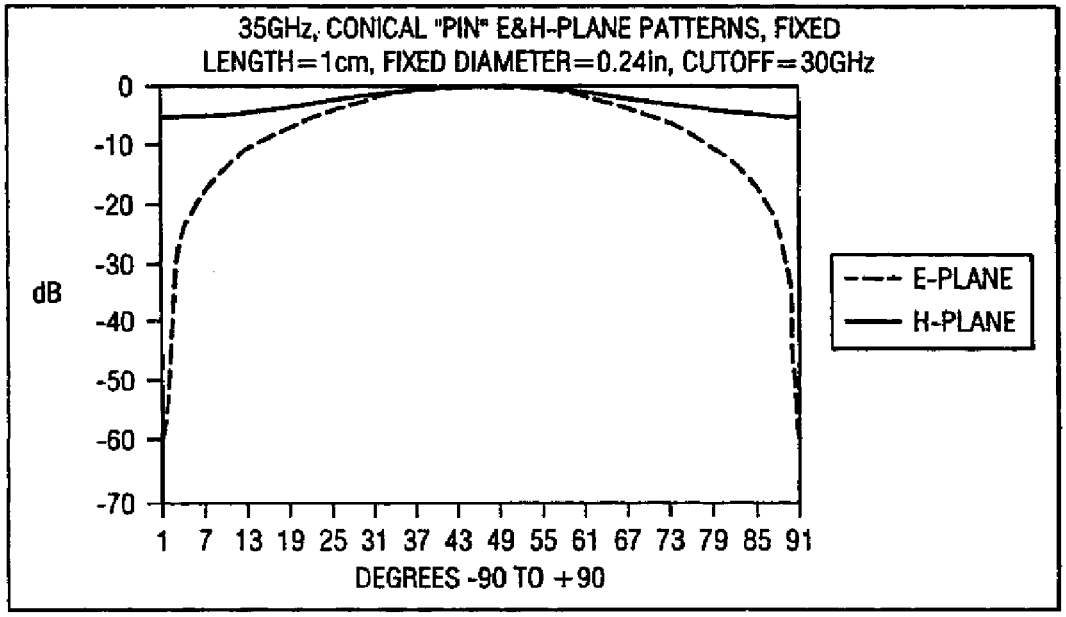
FIGS. 6-9 show plots of antenna power patterns associated with respective variations of the present invention.
Figure 7:
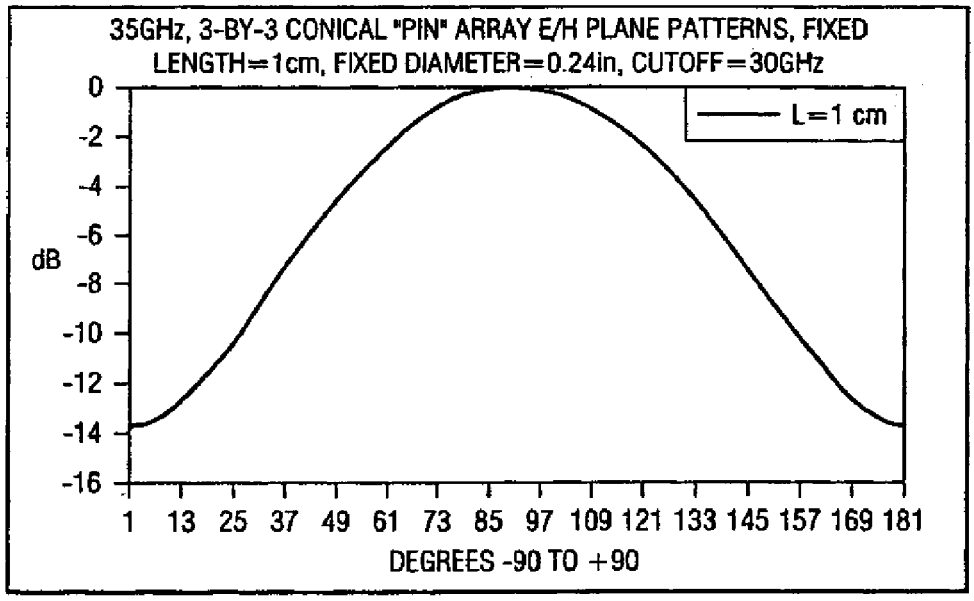
Figure 8:
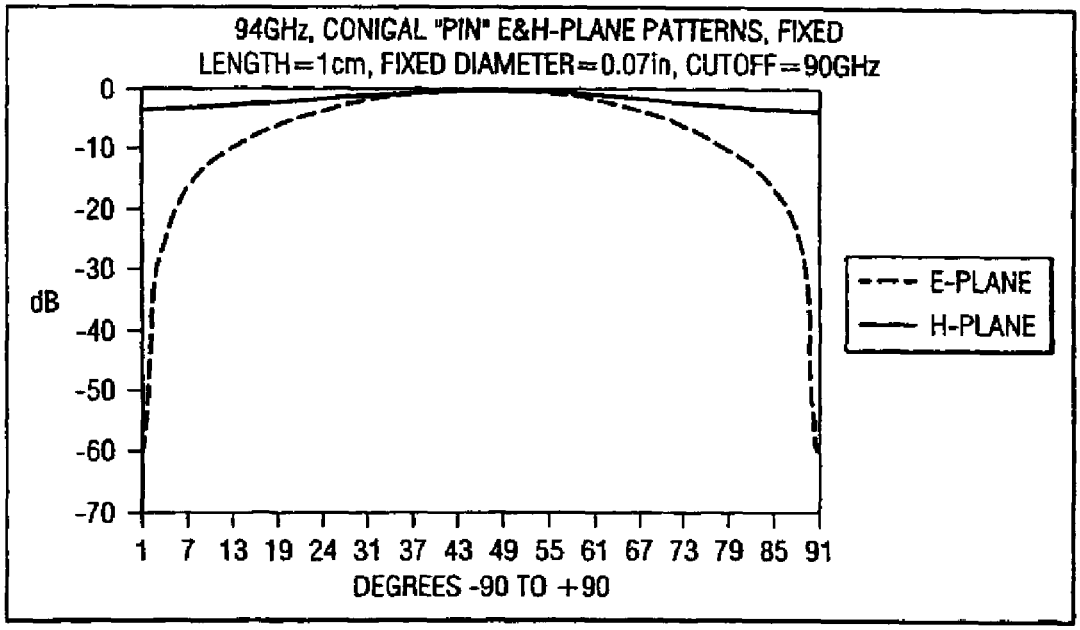
Figure 9:
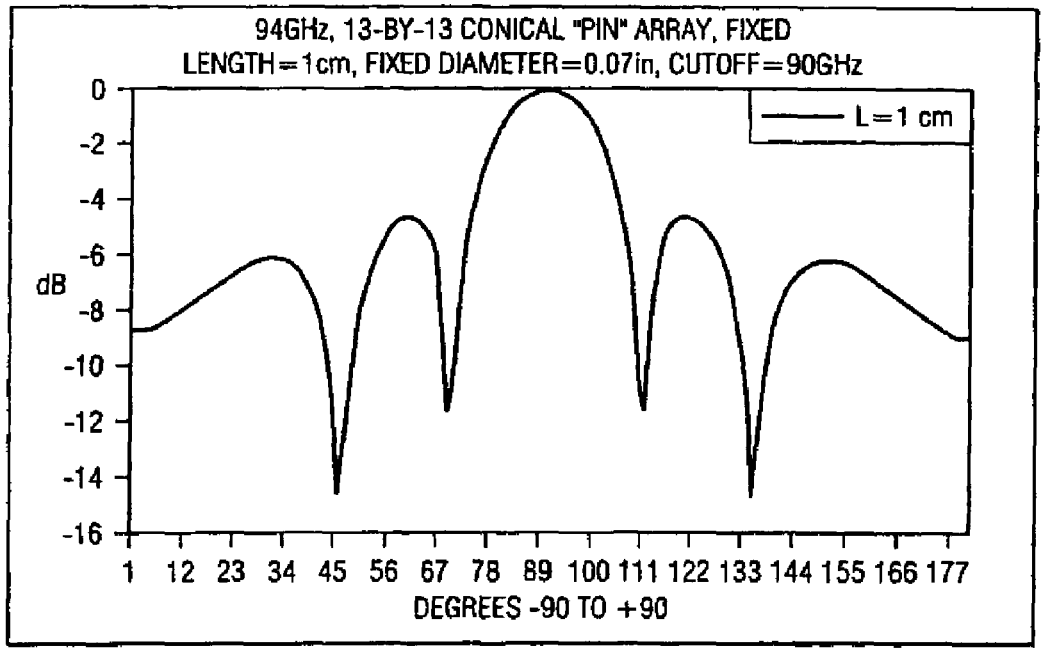

Numerical comparisons between FIGS. 6 and 7 (both 35 GHz plots) show improvement in beam shaping when an array of contact elements is used. In FIG. 6, a plot is shown for a single contact element 100, which presents a beamwidth of 100° and 72° for E and H planes, respectively. On the other hand, FIG. 7 shows a plot for an array of 9 pins, which present a pattern of 68° beamwidth for both E and H planes. Numerical comparisons between FIGS. 8 and 9 also show improvement in beam shaping for an array of contact elements 100 as opposed to a single contact element 100, where beamwidth is reduced from E=156° and H=76° to 18° with sidelobes at −13 dB at 30° off boresight. Thus, arrangement of the contact elements 100 in a connector can be selected to suit desired beamwidth and sidelobe characteristics.

Figure 10:
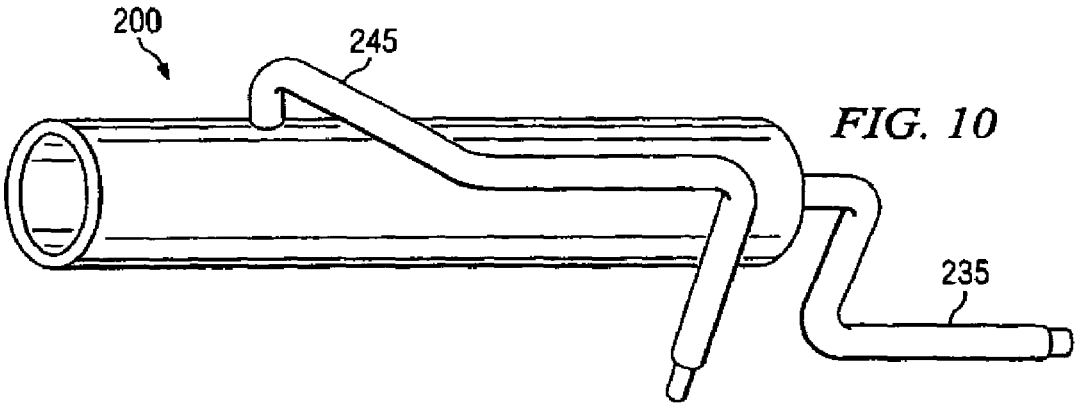
FIG. 10 shows a perspective view of a contact element according to a second embodiment of the present invention.
Figure 11:
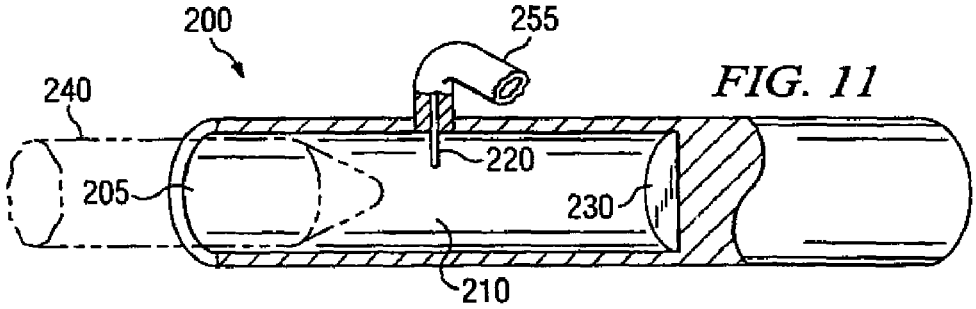
FIG. 11 shows a partially cut-away view of the contact element shown in FIG. 10.
Figure 13:
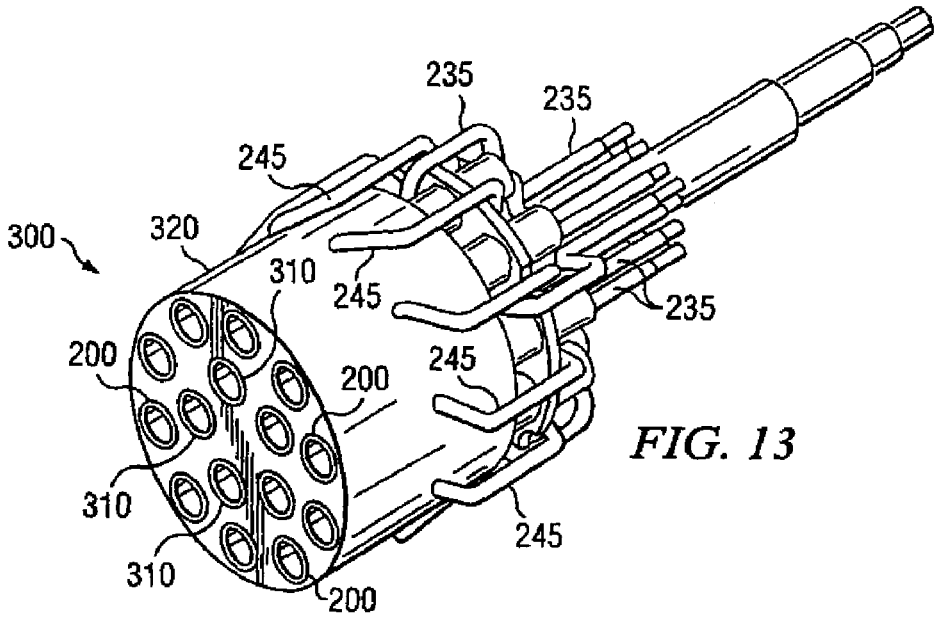
FIG. 13 shows a perspective view of a connector assembly for use with one or more contact elements of the present invention.

Turning now to FIGS. 10 and 11, a contact element 200 is shown in accordance with a second embodiment of the present invention. The contact element 200 differs from the contact element 100 of the first embodiment in that the contact element 200 has no insulating section, but instead has a combined contacting/pick-up section 210.

The contact element 200 can be used for direct-contact and wireless communication. The contact element 200 is preferably constructed primarily of a highly conductive material. Examples of suitable materials include copper, silver, and gold. The contact element 200 has an opening 205 for accommodating the insertion of a pin 240 (shown in phantom). Direct-contact communication can then take place between the contact element 200 and the pin 240, which are in contact with each other allowing for the direct transfer of signals, which can be transferred from the contact element 200 via a contact signal line 235. The contact element 200 also has a probe 220 for injecting and/or absorbing electromagnetic energy in the contact element 200. A probe signal line 245 is provided to transfer signals to and from the probe 220. As described above for the first embodiment, the inner chamber of the contact element 200 from the opening 205 to the back wall 230 acts as a waveguide, particularly when there is no pin 240 present. While the contact element 200 of the second embodiment eliminates the insulating section 125 of the first embodiment, it is still necessary to ensure that the pin 240 is not too long. That is, the pin 240 should be selected such that it will not damage the probe 220 when inserted in the contact element 200.

The manner in which the contact element 200 can be configured (i.e., length, diameter, probe placement, shape variation) with consideration to its function as a waveguide is essentially the same as described above with respect to the first embodiment, and for this reason such description is not repeated here. However, it is worth noting that the contact element 200 represents a much more simplified construction compared to that of contact element 100 since the contact element 200 does not require the insulating section 125.

Figure 12:
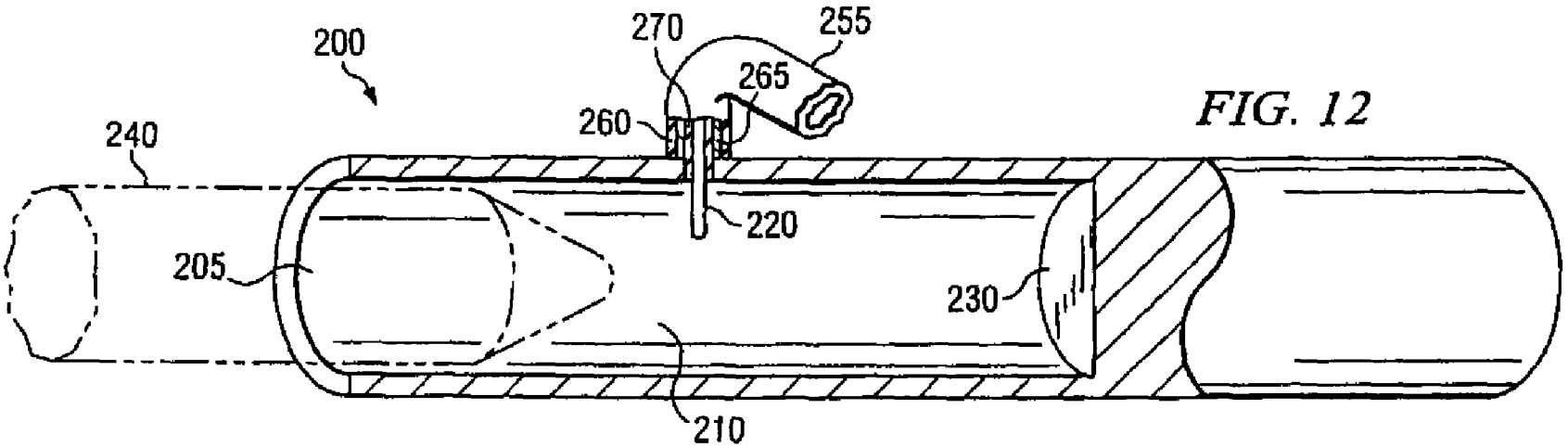
FIG. 12 shows a partially cut-away view of a contact element according to a third embodiment of the present invention.

Turning now to FIG. 12, a third embodiment of the present invention is shown. In the third embodiment, a probe signal line 255 is used in place of both the probe signal line 245 and the contact signal line 235 of the second embodiment. The probe signal line 255 is a multi-layer signal line having alternating layers of conductors and insulators. For example, the probe signal line 255 can be a shielded coaxial cable. As shown in FIG. 12, the probe signal line includes an outer insulating layer 260, an outer conducting layer 265, an inner insulating layer 270, and an inner conductor, which in this case is the probe 220. The probe 220 is insulated from the conductive surface of the contact element 200 by the inner insulating layer 270. On the other hand, the outer conducting layer 265 is in contact with the conductive surface of the contact element 200. Therefore, the outer conducting layer 265 can be used to transfer direct-contact signals to and from the contact element 200 in place of a separate contact signal line 235.

Turning now to FIGS. 13-16, an example of a connector assembly 300 populated with contact elements of the present invention will be discussed. The connector assembly 300 includes a plurality of contact elements 200 according to the second embodiment. The connector assembly is also populated with a plurality of contact elements 310, which are designed to be used only for direct-contact (i.e., contact elements 310 have no probe 220). The connector assembly 300 includes a support member 320, which is constructed of an insulating material such as rubber or plastic. The support member 320 aids in maintaining the spacing and orientation of the contact elements 200 and 310. It will be appreciated that the connector assembly can be equipped with additional connector hardware not shown including a backshell, shield, strain relief, hood, receptacle plate, coupling ring or collar. It will also be appreciated that any embodiment of the contact elements of the present invention can be used in the connector assembly 300.

Figure 14:
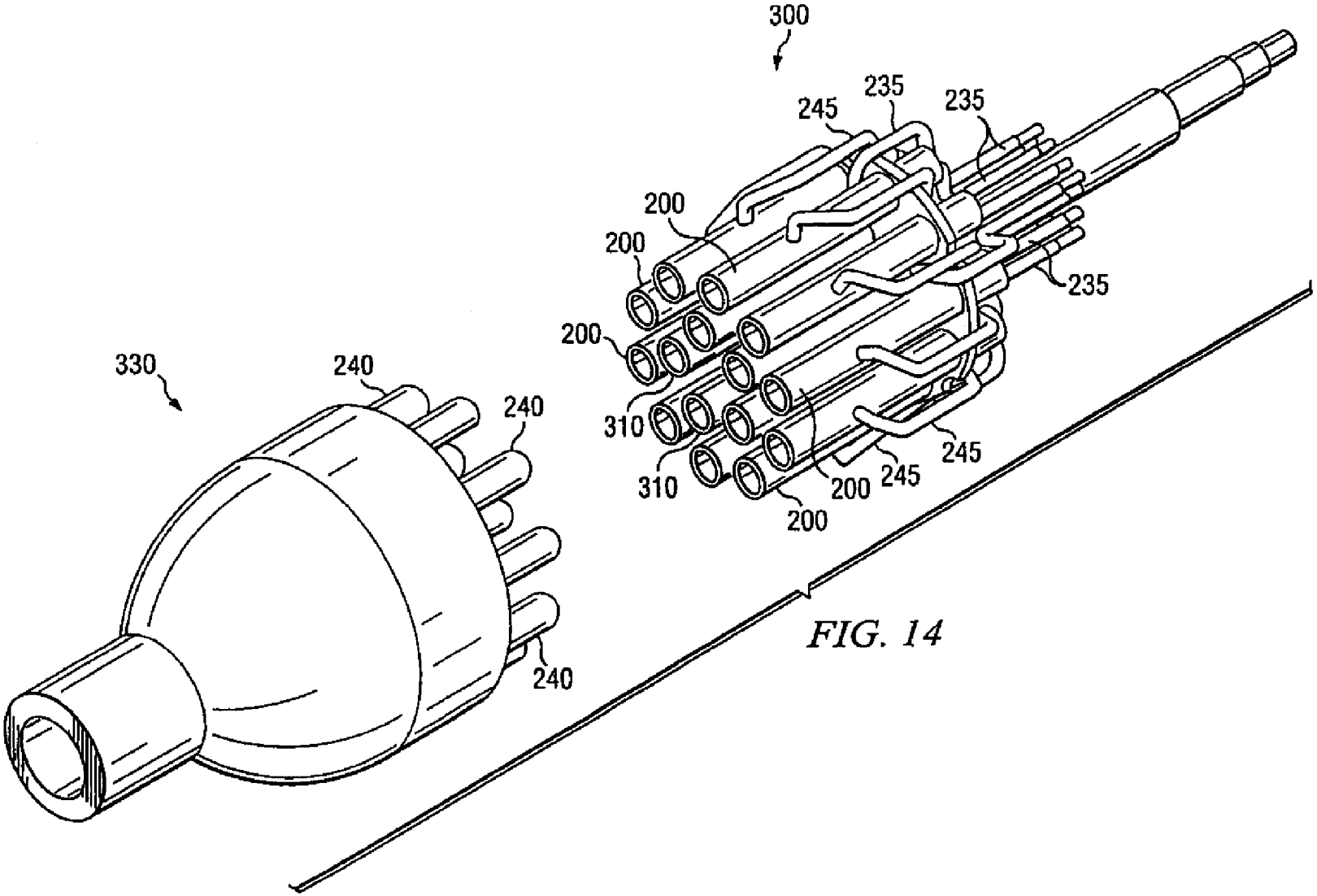
FIG. 14 shows a perspective view of the connector assembly shown in FIG. 13 aligned with a plug assembly.
Figure 15:
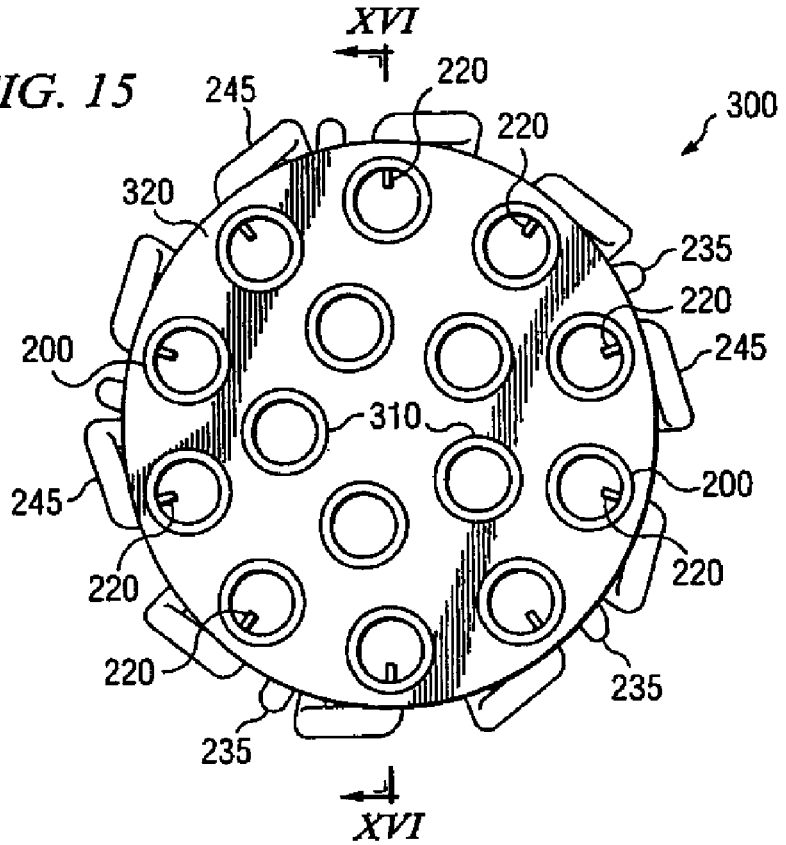
FIG. 15 shows a plan view of the connector assembly shown in FIG. 13.
Figure 16:
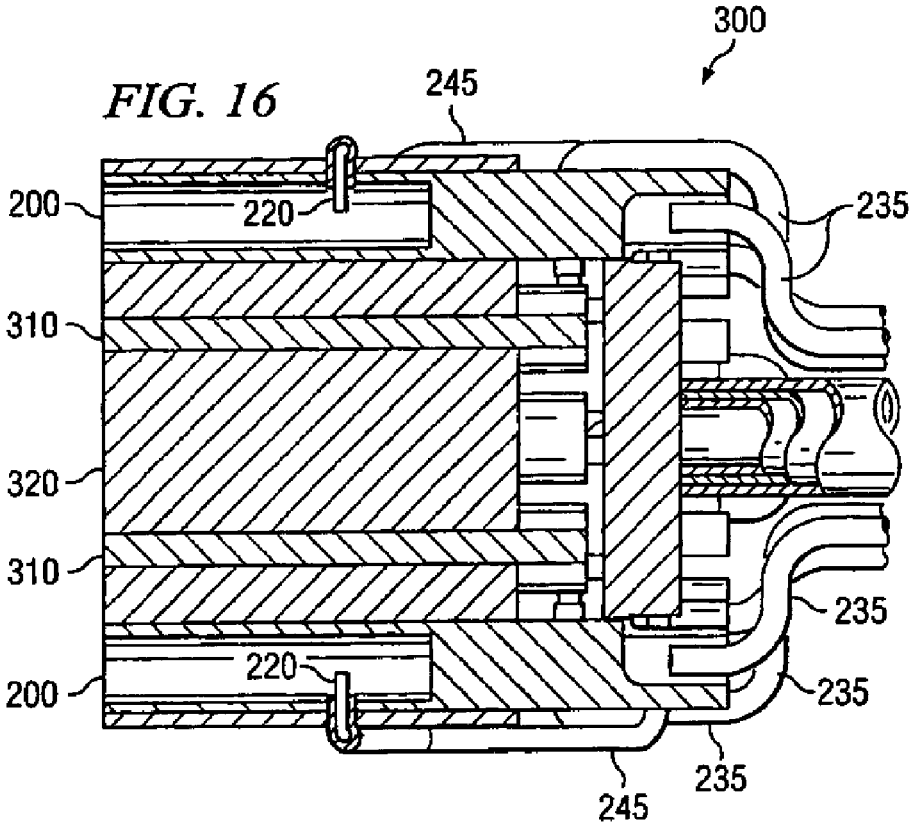
FIG. 16 shows a cross-sectional view taken along lines XVI-XVI shown in FIG. 15.

FIG. 14 shows a perspective view of the connector assembly 300 without the support member 320. FIG. 14 also shows a plug assembly 330 aligned with the connector assembly 300 for connection therewith. FIG. 15 shows a plan view of the connector assembly 300, providing a direct view into the contact elements 200 and 310. FIG. 16 shows a cross-sectional view the connector assembly 300 along section XVI-XVI shown in FIG. 15.

The plug assembly 330 is populated with a plurality of pins 240 for providing direct-contact communication with respective contact elements 200/310 when connected. Thus, it will be appreciated that the contact elements 200 of the connector assembly 300 serve a dual purpose by providing both direct-contact communication and wireless communication. That is, when the connector assembly 300 is connected to the plug assembly 330, the contact elements serve as a conduit for direct-contact communication with pins of the plug assembly 330. On the other hand, when the connector assembly 300 is not connected to the plug assembly 330, the contact elements 200 are free to act as waveguides.

From the view shown in FIG. 15, it can be seen that each of the contact elements 200 is provided with a respective probe 220, probe signal line 245, and contact signal line 235, while each of the contact elements 310 is provided with only a respective contact signal line 235. As shown in FIG. 16, the probe signal line 245 can be a cable having a solid center conductor that extends into the contact element 200 to serve as the probe. On the other hand, it is contemplated that the contact element 200 can be fitted with a separate element, such as a pin or the like, to serve as the probe 220, or the probe 220 can be integrally formed with the body of the contact element 200, in which cases the probe signal line 245 could be connected or attached to the contact element 200 such that the center conductor of the probe signal line is in communication with the probe 220.

It will also be noted that, in the configuration shown in FIG. 15, the contact elements 200 populate all of the outer positions of the connector assembly 300, while the contact elements 310 populate all of the inner positions of the connector assembly 300. However, this configuration is shown only as an example of a connector populated with the contact elements 200 in combination with other types of contact elements, and is no way intended to limit the scope of the present invention. Rather, as discussed above, the arrangement of and number of contact elements 200 can be varied to satisfy design requirements. For example, it is contemplated that a connector assembly in accordance with the present invention can be a single or multi-contact connector having one or more contact elements 200 in combination with none of the contact elements 310 or in combination with one or more of the contact elements 310.

Figure 17:
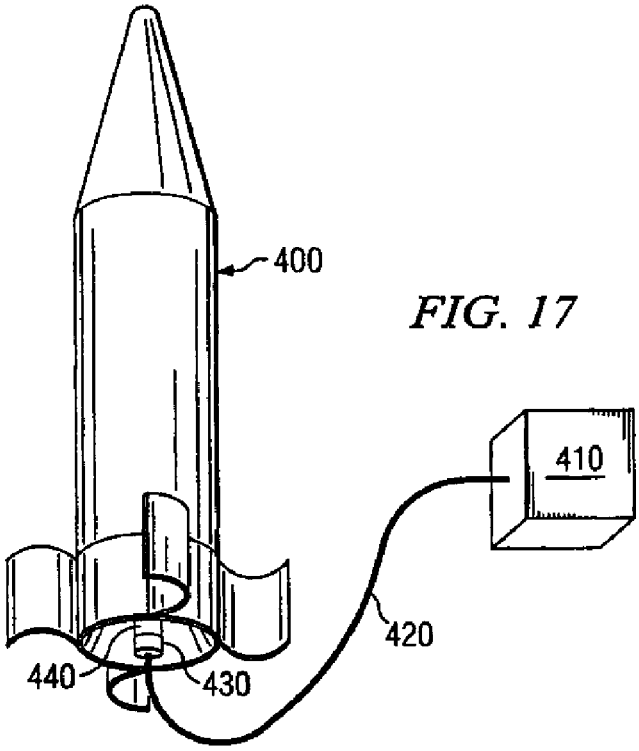
FIG. 17 shows a projectile utilizing the contact element of the present invention in a pre-launch configuration.

There are numerous applications that would benefit from the use of a connector that can serve to provide both wireless and direct-contact types of communications. One such application is in the field of guided projectiles as illustrated in FIGS. 17-19. FIG. 17 shows a projectile 400 in a pre-launch configuration, FIG. 18A shows the projectile 400 after launch, FIG. 18B is a plan view of the base of the projectile 400 during flight, and FIG. 19 shows a block diagram of the control system within the projectile 400.

Prior to launch, the projectile 400 is connected to a pre-launch controller 410 via an umbilical cord 420. The umbilical cord 420 is attached to a projectile connector 440 on the projectile 400 via an umbilical cord connector 430. The projectile connector 440 includes one or more contact elements, such as contact elements 100 and 200 discussed above, that can provide direct-contact and wireless communication. The umbilical connection to the projectile 400 can be used to download critical data from the pre-launch controller 410 before launch as a means of initializing missile systems and providing most recent target data. More specifically, electrical signals sent from the pre-launch controller 410 are transferred to a data processor 480 on the projectile 400 via one or more contact elements 100/200 of the projectile connector 440.

Figure 18A:
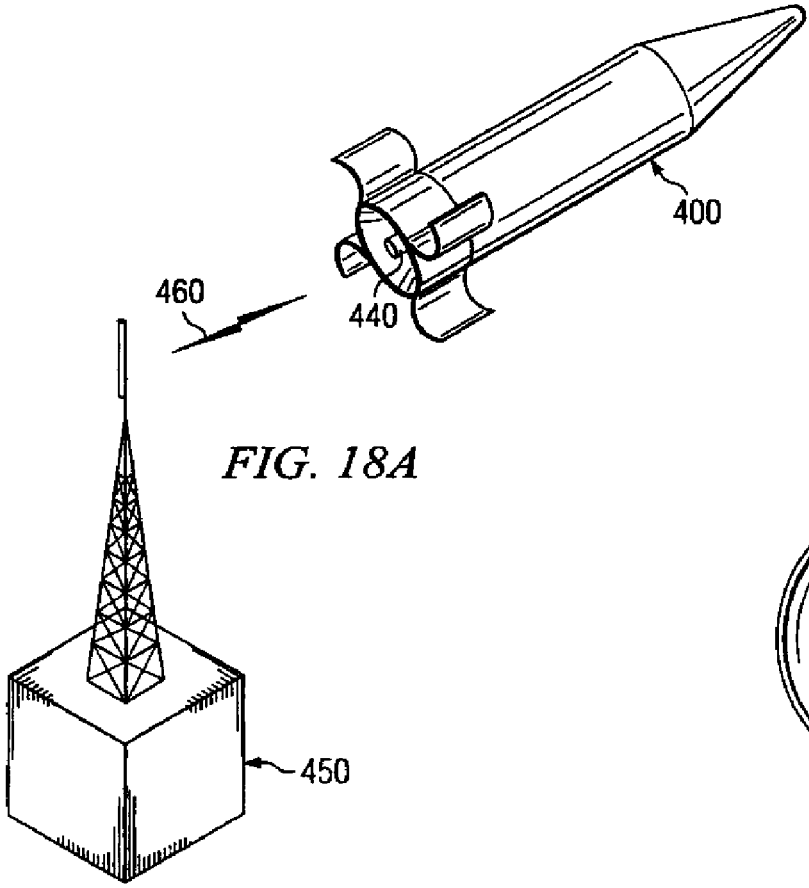
FIG. 18A shows the projectile of FIG. 17 in a post-launch configuration.
Figure 18B:
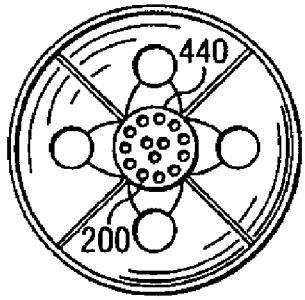
FIG. 18B shows a plan view of the base of the projectile of FIG. 18A.
Figure 19:
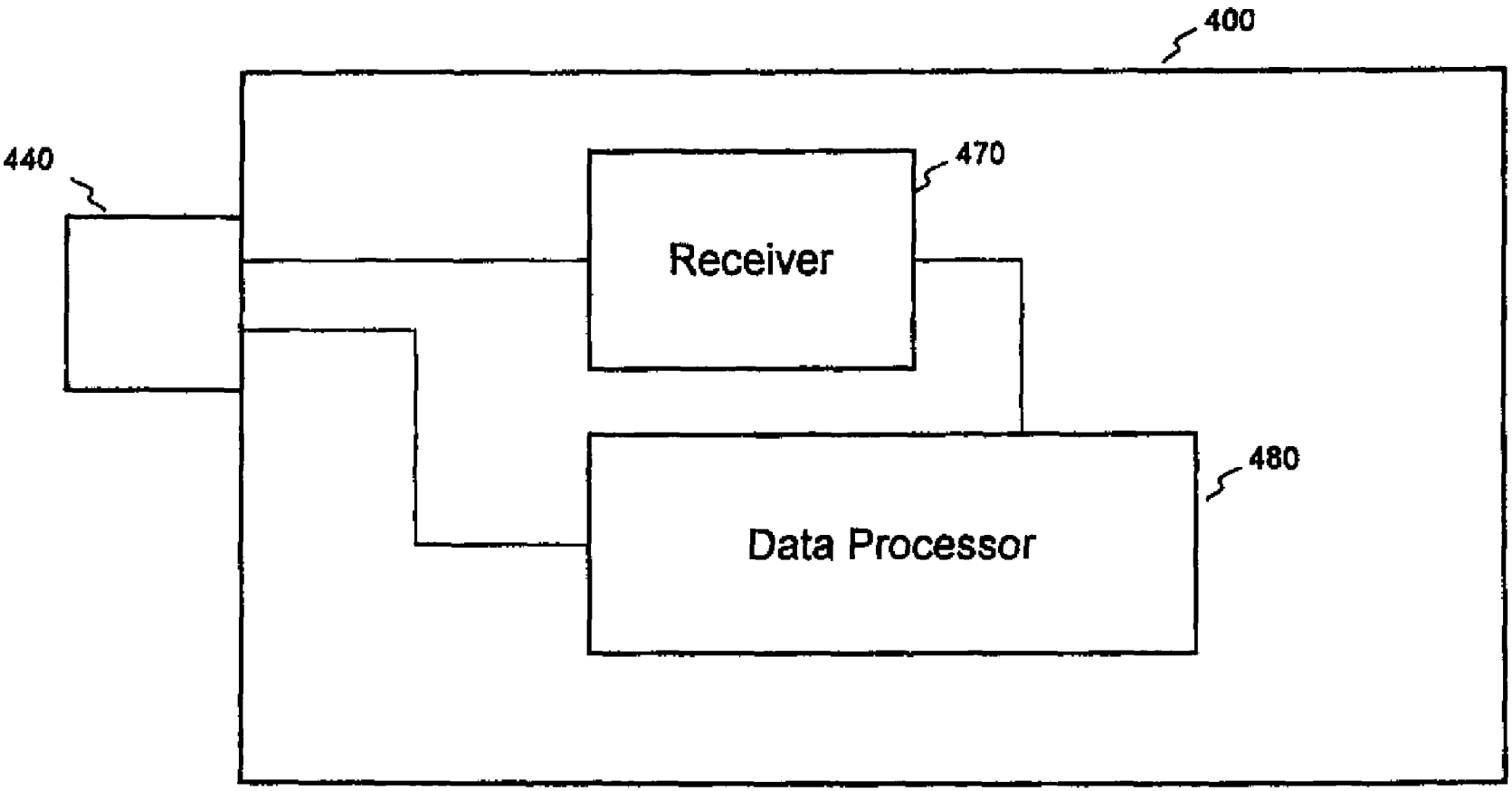
FIG. 19 shows a block diagram of the projectile of FIG. 17.

After launch, as shown in FIG. 18A, communication to the projectile 400 is conducted from a transmitting device 450, which can optionally be included in the same system as the pre-launch controller 410. A signal 460 emitted from the transmitting device 450 is picked up by the contact elements 100/200 of the projectile connector 440 and passed on to a receiver 470. The receiver 470 conditions the picked-up signal according to known methods, converting it into electrical signals for use by the data processor 480. Such communication after launch can be useful for in-flight control of the projectile 400, for example, to alter target data.

Prior missiles have an umbilical connector for pre-launch (direct contact) communications and an omni or near omni-directional antenna for post-launch (wireless) communications. These antenna dominate regions of the missile body, absorbing valuable real estate, weight, and cost dedicated to proper operation of the antenna and associated receiver electronics. The projectile 400, on the other hand, makes use of the projectile connector 440 for both direct-contact and wireless communications, thus eliminating the need for an additional antenna mounted to the missile body. In addition, compared to prior missiles, the performance of the projectile 400 is enhanced due to the use of an aft looking antenna that is highly directional, instead of an omni or near omni-directional antenna on the missile body, which is less directional and therefore requires the use of guard channels, which in turn require additional components. Also, the use of the projectile connector 440 adds an element of stealthiness to the capabilities of the projectile 400, since the projectile connector 440 can have the same exterior appearance as a standard prior connector so that a visual inspection of the projectile 400 would be less likely to reveal the presence of wireless capabilities.

Other applications where a dual use connector (i.e., direct contact and wireless) can be of use include rockets, satellites, and space vehicles, especially where there are space/weight limitations.

Although the present invention has been fully described by way of preferred embodiments, one skilled in the art will appreciate that other embodiments and methods are possible without departing from the spirit and scope of the present invention.

What is claimed is:

1. A projectile comprising:

a combination antenna-conductor connector having a contact element for mating with a pin element of an opposing connector in order to transfer electrical signals from the pin element and for serving as a waveguide for receiving wireless communication signals in response to the pin element being removed from the contact element;

a receiver in communication with the contact element for converting the received wireless communication signals into data signals;

a data processor in communication with the contact element for receiving from the contact element the electrical signals transferred from the pin element.

2. A projectile according to claim 1, wherein the contact element is shaped so as to convert circular mode electromagnetic waves entering the therein into where $\lambda_c$ is a lower dominant mode cutoff wavelength of an operating frequency of the contact element and k is a constant associated with an operating mode of the contact element.

3. A projectile according to claim 1, wherein the contact element includes an opening for receiving the pin element and a back wall and wherein the contact element includes a contacting section that is electrically conductive and extends from the opening towards the back wall.

4. A projectile according to claim 3, wherein the contact element includes a pickup section that is electrically conductive and extends from the back wall towards the opening.

5. A projectile according to claim 4, wherein the surface contact element includes an insulating section between the contacting section and the pickup section for electrically isolating the contacting section and the pickup section from each other.

6. A projectile according to claim 4, including a pickup element extending from the pickup section of the contact element.

7. A projectile according to claim 6, wherein a distance d between the pickup element and the back wall satisfies the following relationship:

$$d = \frac{1}{4}\lambda_g = \frac{1}{4}\sqrt{\frac{\lambda_o}{(1-\lambda_o/\lambda_c)^2}}$$

where $\lambda_g$ is a wavelength of an operating frequency of the contact element, $\lambda_c$ is a lower dominant mode cutoff wavelength of the operating frequency, and $\lambda_o$ is a wavelength of the operating frequency in free space.

8. A projectile according to claim 1, wherein the opening in the contact element is circular and has a radius r that satisfies the following equation:

$$r = \frac{\lambda_c}{k}$$

wavelength of the operating frequency in free space.

9. A projectile control system comprising:

a projectile having a projectile connector that includes a contact element;

a pre-launch controller for communicating with the projectile prior to a launch of the projectile;

an umbilical cord for electrically connecting the contact element of the connector to the pre-launch controller;

a transmitting device for wirelessly communicating with the projectile via the contact element of the connector after the launch of the projectile.

10. A projectile control system according to claim 9, wherein the contact element is shaped so as to convert circular mode electromagnetic waves entering the therein into rectangular mode waves.

11. A projectile control system according to claim 9, wherein the contact element includes an opening for receiving at least one pin of the umbilical cord and a back wall and wherein the contact element includes a contacting section that is electrically conductive and extends from the opening towards the back wall.

12. A projectile control system according to claim 11, wherein the contact element includes a pickup section that is electrically conductive and extends from the back wall towards the opening.

13. A projectile control system according to claim 12, wherein the contact element includes an insulating section between the contacting section and the pickup section for electrically isolating the contacting section and the pickup section from each other.

14. A projectile control system according to claim 12, including a pickup element extending from the pickup section of the contact element.

15. A projectile control system according to claim 14, wherein a distance d between the pickup element and the back wall satisfies the following relationship:

$$d = \frac{1}{4}\lambda_g = \frac{1}{4}\sqrt{\frac{\lambda_o}{(1-\lambda_o/\lambda_c)^2}}$$

where $\lambda_g$ is a wavelength of an operating frequency of the contact element, $\lambda_c$ is a lower dominant mode cutoff wavelength of the operating frequency, and $\lambda_o$ is a rectangular mode waves.

16. A projectile control system according to claim 11, wherein the opening in the contact element is circular and has a radius r that satisfies the following equation:

$$r = \frac{\lambda_c}{k}$$

where $\lambda_c$ is a lower dominant mode cutoff wavelength of an operating frequency of the contact element and k is a constant associated with an operating mode of the contact element.

* * * * *